US006007266A

United States Patent [19]

Cheng et al.

[11] Patent Number: 6,007,266

[45] **Date of Patent: *Dec. 28, 1999**

[54] FASTENER FOR A RING BINDER AND METHOD OF PRODUCING A BINDER ASSEMBLY

[75] Inventors: Hung Yu Cheng, Siu Lek Yuen Shatin N.T.; Chun Yuen To, Kauto Shan Shatin N.T.; Weng Io Ng, Quarry Bay, all of The Hong Kong Special Administrative Region of the People's Republic of China

[73] Assignee: World Wide Stationery Manufacturing Co., Ltd., New Territories, The Hong Kong Special Administrative Region of the People's Republic of China

[ * ] Notice: This patent is subject to a terminal disclaimer.

[21] Appl. No.: 09/100,945

[22] Filed: Jun. 22, 1998

Related U.S. Application Data

[63] Continuation-in-part of application No. 08/707,398, Sep. 4, 1996, and application No. 08/915,732, Aug. 21, 1997.

[51] Int. Cl.[6] ..... B42F 3/04

[52] U.S. Cl. ..... 402/36; 402/26; 402/70; 402/73; 228/182; 228/432; 418/457; 418/461

[58] Field of Search ..... 228/182, 432; 29/513; 219/86.1; 73/842; 402/31, 32, 35, 36, 38, 39, 41, 42; 411/457, 461, 462, 463–467

[56] References Cited

U.S. PATENT DOCUMENTS

| | | | |
|---|---|---|---|
| 951,946 | 3/1910 | Force . | |
| 1,788,817 | 1/1931 | Wilson et al. . | |
| 1,895,972 | 1/1933 | Childs . | |
| 2,857,665 | 10/1958 | Cohen | 29/513 |
| 3,252,461 | 5/1966 | Schade . | |
| 3,515,841 | 6/1970 | King | 219/91 |
| 3,909,049 | 9/1975 | Blatnica | 285/329 |
| 4,495,397 | 1/1985 | Opprecht et al. | 219/93 |
| 4,697,945 | 10/1987 | Geiger | 402/75 |
| 5,100,253 | 3/1992 | Cooper | 402/75 |
| 5,113,054 | 5/1992 | Hund et al. | 219/117.1 |
| 5,160,209 | 11/1992 | Schuessler | 402/75 |
| 5,269,616 | 12/1993 | O'Neill | 402/74 |
| 5,354,142 | 10/1994 | Yu . | |
| 5,755,513 | 5/1998 | To | 402/36 |
| 5,772,348 | 6/1998 | To . | |
| 5,842,807 | 12/1998 | To . | |

FOREIGN PATENT DOCUMENTS 2304637A 3/1997 United Kingdom .

*Primary Examiner*—Willmon Fridie, Jr.
*Assistant Examiner*—Alisa L Thurston
*Attorney, Agent, or Firm*—Birch, Stewart, Kolasch & Birch, LLP

[57] ABSTRACT

A binder assembly includes a sheet retaining device having a plurality of rings for engaging corresponding holes in sheets of material retained by the sheet retaining device. The sheet retaining device is attached to a cover member by a fastener having a portion which is insertable into apertures in the sheet retaining device and securable thereto by pressing. The fastener includes a rectangular base having deformable claws which become embedded in the cover member when installed to securely hold the sheet retaining device to the cover member. The embedded claws are concealed from an outer surface of the cover member, thereby improving the exterior appearance of the binder assembly.

34 Claims, 7 Drawing Sheets

FASTENER FOR A RING BINDER AND METHOD OF PRODUCING A BINDER ASSEMBLY

This is a continuation-in-part of application Ser. No. 08/707,398, filed Sep. 4, 1996, and a continuation-in-part of application Ser. No. 08/915,732, filed Aug. 21, 1997, the entire contents of both of which are hereby incorporated by reference.

BACKGROUND OF THE INVENTION

1. Field of the Invention

The present invention relates to a ring binder assembly, and more particularly, to a fastener for securing a sheet retaining apparatus to a binder cover to form the ring binder assembly.

2. Description of the Background Art

Various ring binders are known in the art which have a paper sheet retaining device attached to a cover member by a plurality of fasteners, such as rivets, which extend through the cover member and which are deformed, for example, by punching, to securely and permanently fix the paper retaining device to the cover member.

A disadvantage associated with such conventional ring binders is that the assembling process is both laborious and prone to error. It is necessary to provide the assemblers with rivets properly sized and shaped to fit both of the corresponding holes in the paper retaining device and the cover member. The assemblers must secure the paper retaining device to the cover member by first inserting the rivet through the cover member, then through the paper retaining device, and then deforming the tail of the rivet by punching to engage the upper plate of the paper retaining device.

A further disadvantage associated with such conventional ring binders is that the rivets extend through the cover member and are visible on the exterior of the cover member, thereby detracting from the overall appearance of the ring binder.

SUMMARY OF THE INVENTION

Accordingly, it is an object of the present invention to provide a fastener for a ring binder assembly which minimizes the labor intensive steps associated with assembling the sheet retaining apparatus to the cover member.

It is a further object of the present invention to provide a binder assembly having a sheet retaining apparatus secured to the cover member by a fastener which is preferably not visible on the exterior of the cover member.

It is yet another object of the present invention to provide a method of producing a binder assembly which is less labor intensive and economical to implement.

These and other objects of the present invention are achieved by a fastener for securing a sheet retaining device having an aperture at each end thereof to a cover member, the fastener comprising a base having a first side and an opposed second side, an elongated member having a first end secured to the first side of the base, and a second end insertable through the aperture and securable to the sheet retaining device, and a plurality of deformable claws extending from the base in a direction away from the second side for engagement with the cover member.

The objects of the present invention are further achieved by a binder assembly comprising a cover member having a front cover, a back cover, and a spine located between the front cover and the back cover, a sheet retaining device having an aperture at each end thereof, and a fastener securing the sheet retaining device to the cover member, the fastener comprising a base having a first side and an opposed second side, an elongated member having a first end secured to the first side of the base, and a second end insertable through the aperture and secured to the sheet retaining device, and a plurality of deformable claws extending from the base in a direction away from the second side and embedded into the cover member.

The objects of the present invention are additionally achieved by a method of producing a binder comprising the steps of providing a cover member having a front cover, a back cover, and a spine located between the front cover and the back cover, providing a sheet retaining device having an aperture at each end thereof, providing a fastener comprising a base having a first side and an opposed second side, an elongated member having a first end and a second end, and a plurality of deformable claws extending from the base in a direction away from the second side, securing the first end of said elongated member to the first side of the base, inserting the second end of the elongated member through the aperture in the sheet retaining device, securing the second end of the elongated member to the sheet retaning device, and pressing the second side of the base toward the cover member to embed the claws into the cover member, thereby securing the sheet retaining device to the cover member.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION OF THE PREFERRED EMBODIMENTS

Figure 1:
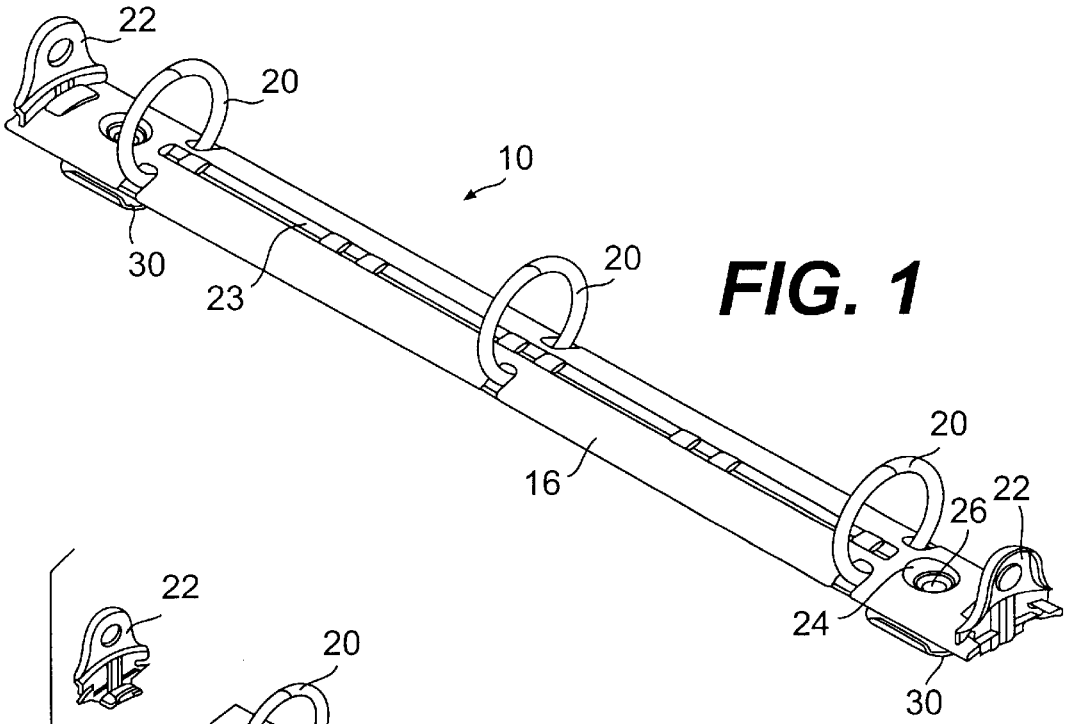
FIG. 1 is a perspective view showing the upper side of the sheet retaining device of the present invention with a fastener according to a first embodiment attached thereto.
Figure 2:
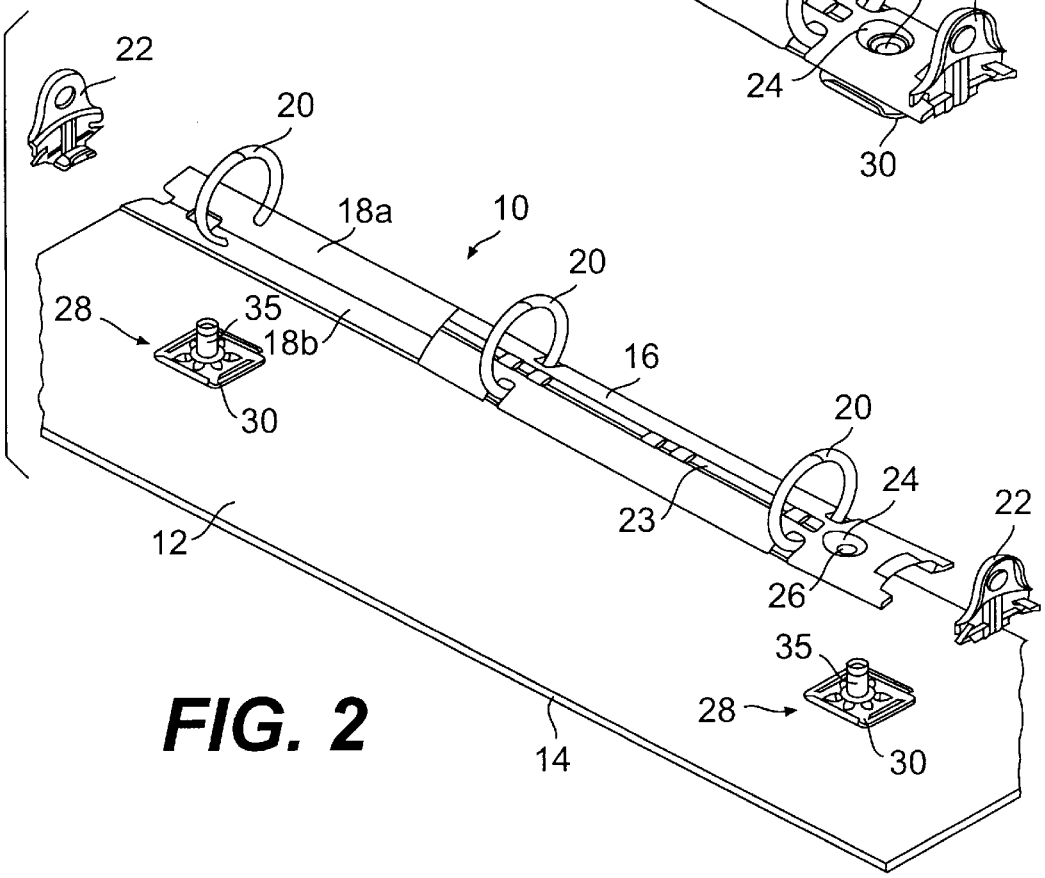
FIG. 2 is an exploded perspective view of the sheet retaining device of FIG. 1.
Figure 3:
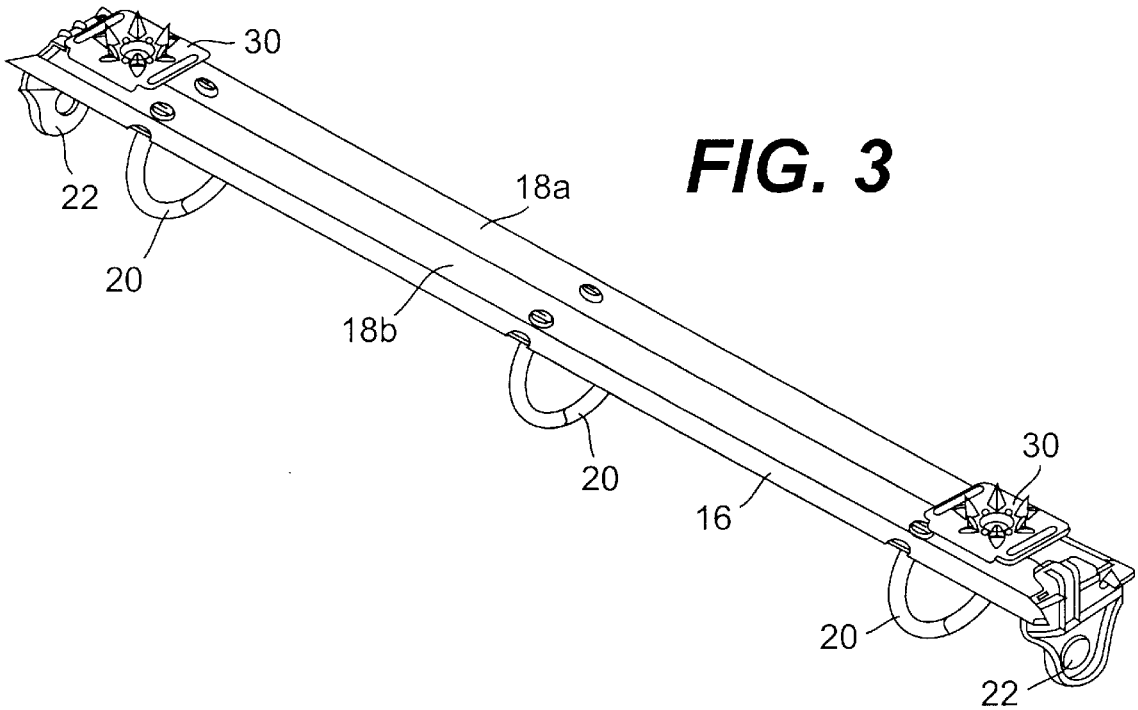
FIG. 3 is a perspective view showing the underside of the sheet retaining device of FIG. 1 with the fastener attached thereto.

Referring in detail to the drawings, and with particular reference to FIGS. 1–3, a sheet retaining device 10 of the present invention is shown. The sheet retaining device 10 is securable to a cover member 12 to produce a ring binder. The cover member 12 includes a spine 14, made of a material such as cardboard, located between front and back covers (not shown) of the cover member 12.

The sheet retaining device 10 includes a substantially rigid curved upper plate 16 supporting a pair of hinged leaves 18*a*, 18*b*. Secured to the hinged leaves 18*a*, 18*b* are a plurality of ring members 20 for engaging corresponding holes in sheets of material retained by the sheet retaining device 10. A lever 22 is located at each end of the curved upper plate 16 for actuating the hinged leaves 18*a*, 18*b* to open and close the ring members 20.

Although three ring members 20 are shown in FIGS. 1 and 2, it should be understood that any number and arrangement of ring members 20 may be utilized. For example, two or four ring members may be utilized. Also, the ring members 20 may be equally spaced-apart, or may have different spacings. Finally, although the ring members 20 shown are circular, it is envisioned that D-shaped or other ring shapes may be utilized.

The curved upper plate 16 includes a reinforcing rib 23 extending longitudinally along the center thereof. The rib 23 reinforces the upper plate 16, thereby increasing the resistance of the upper plate 16 to bending.

The upper plate 16 further includes a depression 24 near each end thereof. Each depression 24 includes an aperture 26 extending through the upper plate 16. Additional details of the sheet retainig apparatus 10 are more fully disclosed in U.S. Pat. No. 5,354,142, the entire contents of which are hereby incorporated by reference.

A fastener 28 is utilized to secure the sheet retaining device 10 to the cover member 12. The fastener 28 includes a base 30 having a first side 32 and an opposed second side 34. The base 30 is securely fastened to the curved upper plate 16 by an elongated substantially cylindrical body 35 having a head 35*a* which extends through the aperture 26 and is securely fastened within the depression 24, for example, by pressing. A flange 35*b* of the substantially cylindrical body 35 is secured to the first side 32 of the base 30 by spot welds 35*c*.

Figure 4:
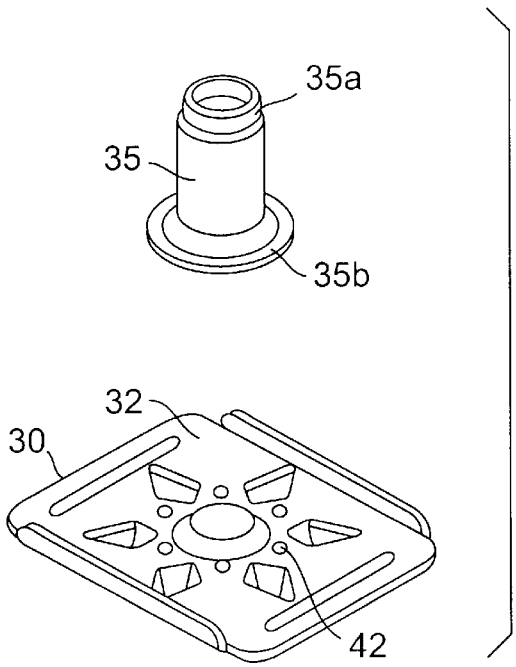
FIG. 4 is an exploded perspective view of the fastener according to the first embodiment.
Figure 5:
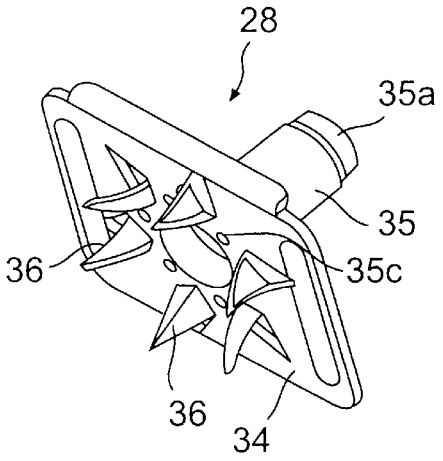
FIG. 5 is a perspective view of one side of the fastener according to the first embodiment.
Figure 6:
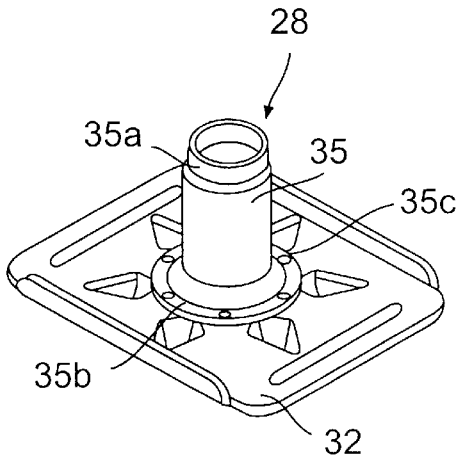
FIG. 6 is a perspective view of the other side of the fastener according to the first embodiment.

Referring now to FIGS. 4–6, in the first embodiment of the fastener 28, the base 30 is rectangular. A plurality of deformable claws 36 are formed in the base 30 approximately centrally thereof and arranged in a circle. In the first embodiment, six claws 36 are shown. However, more or fewer claws 36 may be used as necessary. The claws 36 extend from the base 30 in a direction away from the second side 34 of the base 30. The claws 36 have a substantially triangular tooth-like shape with the apex thereof directed away from the base 30.

The base 30 and the claws 36 are a one-piece unitary structure formed from a flat plate of steel or other metal. The claws 36 are formed by bending the triangular claws 36 at slightly less than a right angle with respect to the base 30 such that the claws 36 are directed outwardly from the center of the base 30. The claws 36 may become somewhat curved outwardly from the center of the base 30 after bending.

Each claw 36 is also bent longitudinally along a midline 40 of the claw 36. This bend serves to stiffen and reinforce the claw 36 against undesirable bending along the claw 36 during installation.

The base 30 of the fastener 28 further includes a plurality of projections 42 protruding from the first side 32 thereof. The projections 42 are substantially hemispherical and are located on the base 30 between the claws 36. A spot welding operation is performed for securely fastening the substantially cylindrical body 35 to the base 30. The projections 42 contact the flange 35*b* of the substantially cylindrical body 35 and become bonded thereto during the spot welding operation.

Figure 7:
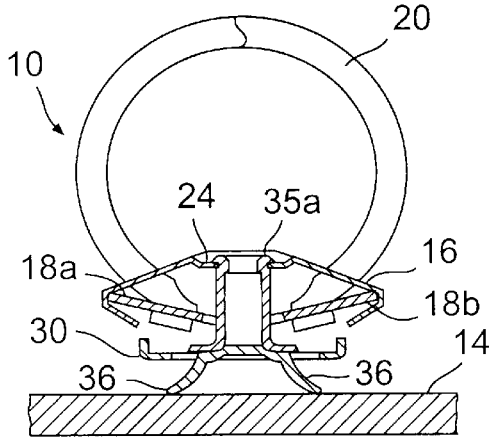
FIG. 7 is an end view of the sheet retaining device prior to attachment to the cover member.
Figure 8:
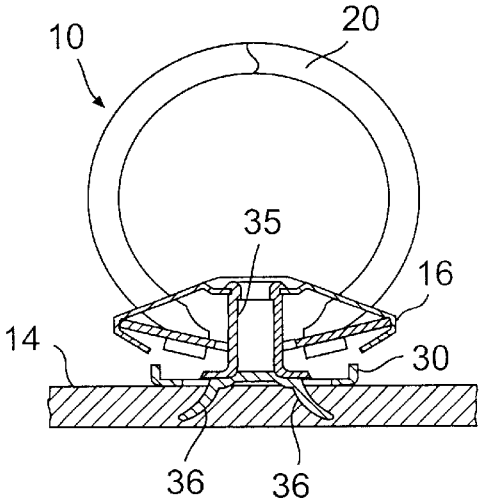
FIG. 8 is a side view of the sheet retaining device attached to the cover member.
Figure 9:
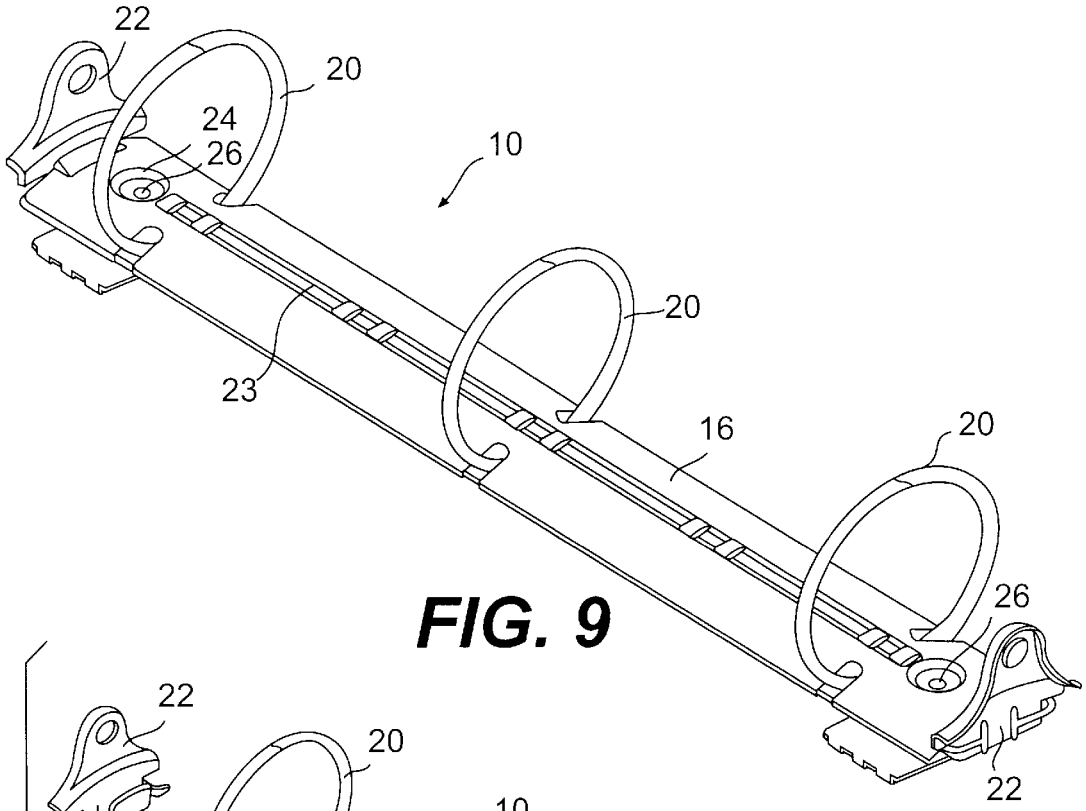
FIG. 9 is a perspective view showing the upper side of the sheet retaining device of the present invention with a fastener according to a second embodiment attached thereto.
Figure 10:
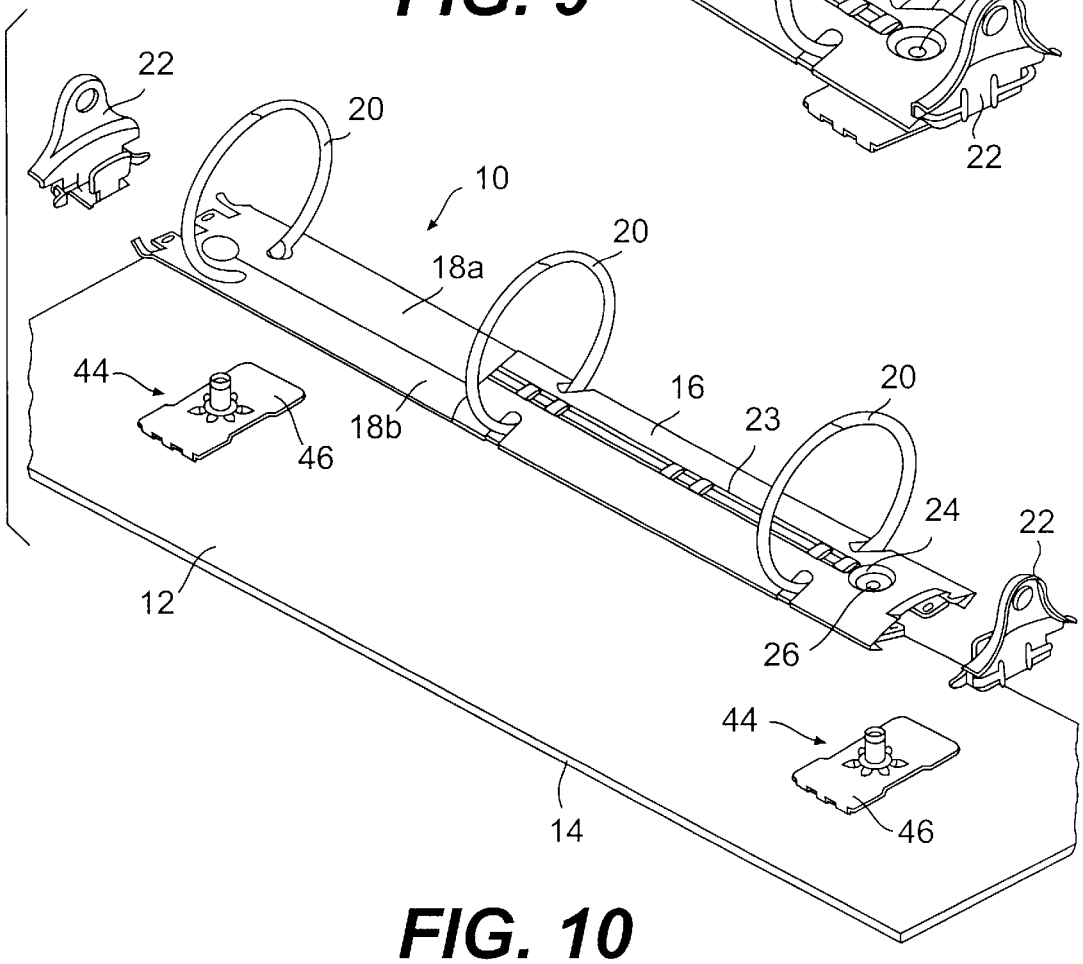
FIG. 10 is an exploded perspective view of the sheet retaining device of FIG. 9.
Figure 11:
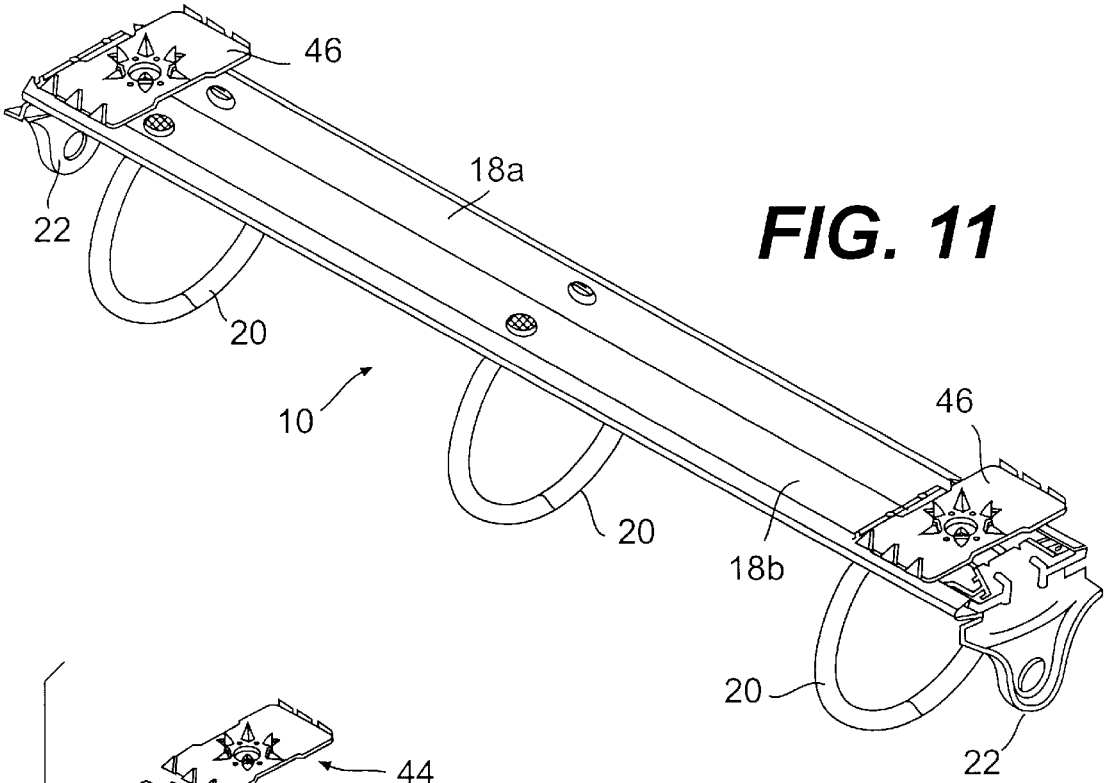
FIG. 11 is a perspective view showing the underside of the sheet retaining device of FIG. 9 with the fastener attached thereto.
Figure 12:
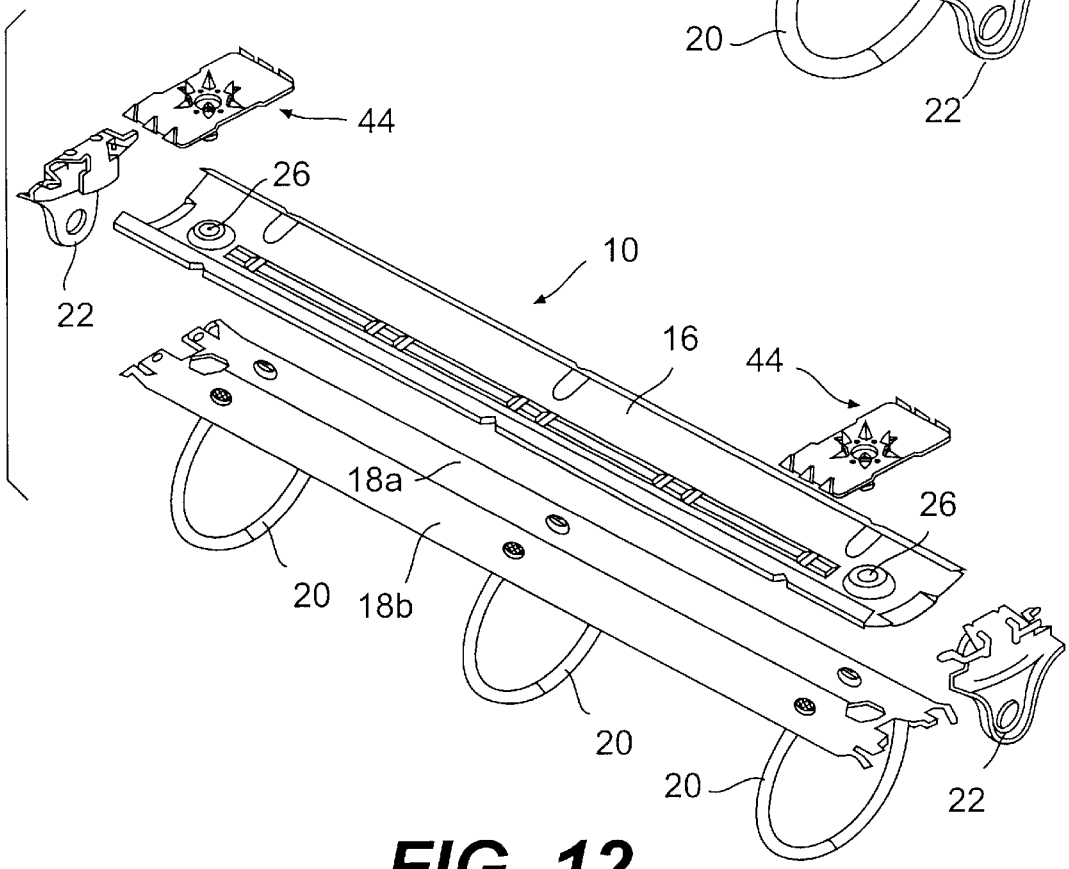
FIG. 12 is an exploded perspective view of the underside of the sheet retaining device of FIG. 9.
Figure 13:
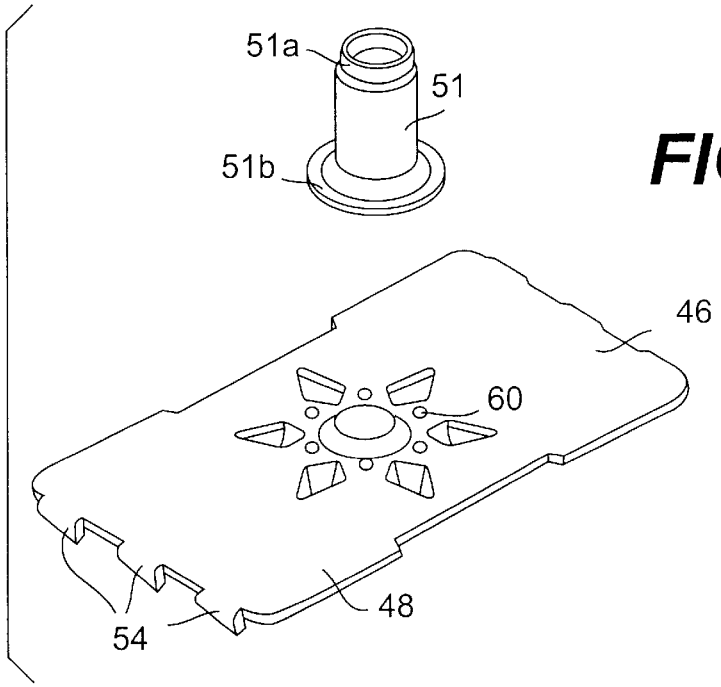
FIG. 13 is an exploded perspective view of the fastener according to the second embodiment.
Figure 14:
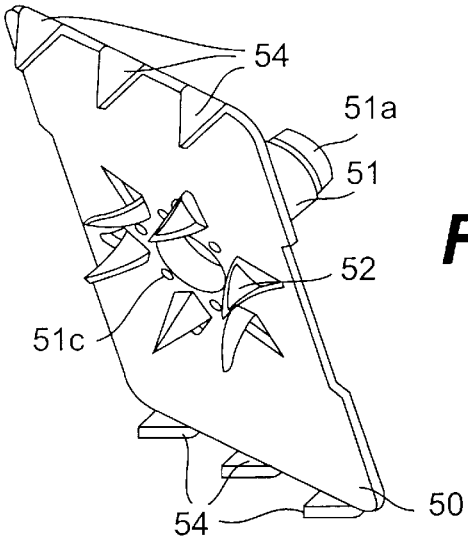
FIG. 14 is a perspective view of one side of the fastener according to the second embodiment.
Figure 15:
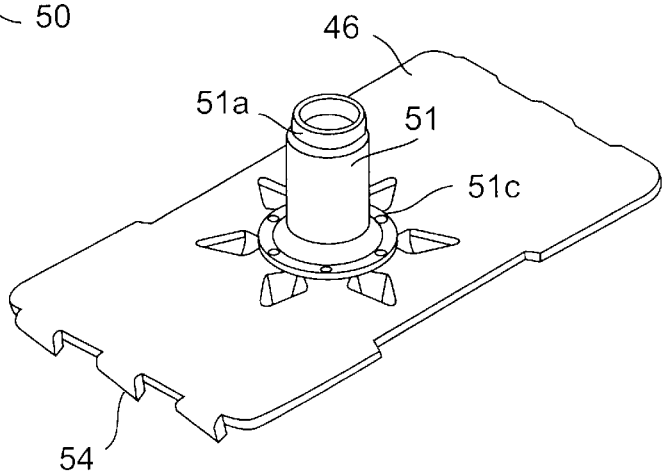
FIG. 15 is a perspective view of the other side of the fastener according to the second embodiment.
Figure 16:
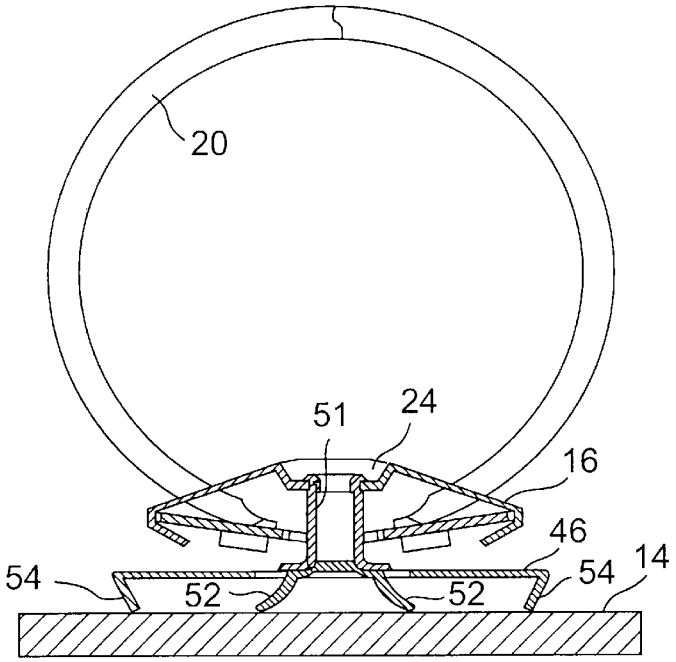
FIG. 16 is an end view of the sheet retaining device prior to attachment to the cover member.
Figure 17:
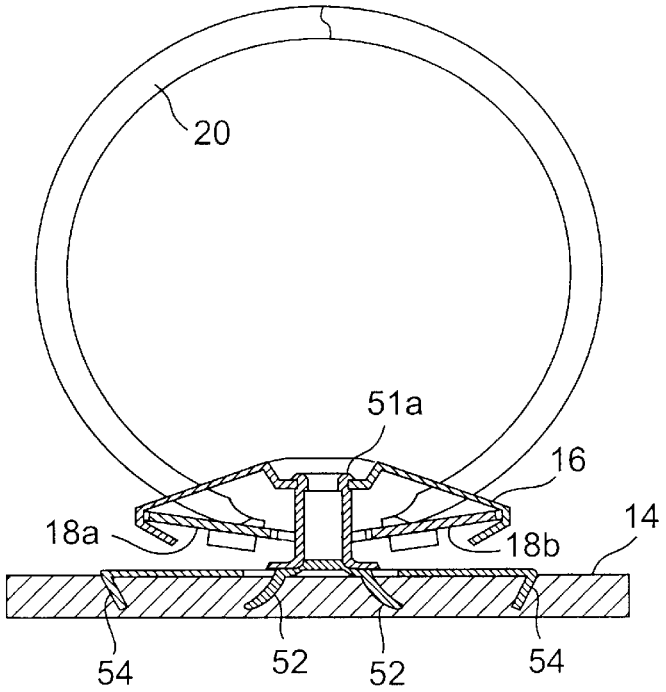
FIG. 17 is a side view of the sheet retaining device attached to the cover member.

Assembly of the sheet retaining device 10 to the cover member 12 will now be described, with particular reference to FIGS. 7 and 8. Each end of the sheet retaining device 10 is attached to the cover member 12 in the same fashion, and the following discussion would therefore apply to each end.

The fastener 28 is located at the underside of the upper member 12 near the end thereof with the substantially, cylindrical body 35 adjacent to the lower side of the upper member 16. The head 35*a* of the substantially cylindrical body 35 is inserted through the aperture 26 and securely fastened thereto by pressing. The fastener 28 is thereby firmly attached to the upper plate 16 of the sheet retaining device 10 with the claws 36 depending downwardly from the upper plate 16 as shown in FIG. 7.

Thereafter, the sheet retaining device 10 is oriented at the desired location with respect to the cover member 12, for example, on the inside of the spine 14. The ends of the sheet retaining device 10 with the fasteners 28 attached thereto are pressed toward the cover member 12 so that the claws 36 become embedded in the cover member 16 as shown in FIG. 8. The sheet retaining device 10 is thereby secured to the cover member 12

The initial outwardly directed nature of the claws 36 promotes movement of the claws 36 outwardly into the cover member 12 so that the claws 36 spread out when pressed into the cover member 12 to securely hold the fastener 28 and the sheet retaining device 10 to the cover member 12. Further, because the claws 36 move outwardly as well as into the cover member 12, the claws preferably do not penetrate completely through the cover member 12, and are therefore not visible on the exterior of the cover member 12. This results in a more pleasing appearance of the exterior of the cover member 12, since the fastener 28 is concealed within the cover member 12.

Referring now to FIGS. 9–17, a second embodiment of the present invention is shown. The same reference numerals which were used in the first embodiment are used in the second embodiment to designate identical or similar features and elements.

The second embodiment is similar to the first embodiment of FIGS. 1–8, except, for example, that the second embodiment utilizes a fastener 44 having a larger substantially rectangular base 46, as shown in FIGS. 9–12. The base 46 has a first side 48 and an opposed second side 50. The base 46 is securely fastened to the curved upper plate 16 by an elongated substantially cylindrical body 51 having a head 51*a* which extends through the aperture 26 and is securely fastened within the depression 24, for example, by pressing. A flange 51*b* of the substantially cylindrical body 51 is secured to the first side 48 of the base 46 by spot welds 51*c*.

A first set of deformable claws 52 are located approximately centrally of the base 46 and arranged in a circle. A second set of deformable claws 54 are located at opposite side edges 56 of the base 46. In the second embodiment, six claws 52 and six claws 54 are shown. However, more or fewer claws 52,54 may be used as necessary. The claws 52,54 extend from the base 46 in a direction away from the second side 50 of the base 46. The claws 52,54 have a substantially triangular tooth-like shape with the apex thereof directed away from the base 46.

The base 46 and the claws 52,54 are a one-piece unitary structure formed from a flat plate of steel or other metal. The first set of claws 52 are formed by bending the triangular claws 52 at slightly less than a right angle with respect to the base 46 such that the claws 52 are directed partially outwardly from the center of the base 46. The second set of claws 54 are formed by bending the triangular claws 54 at slightly more than a right angle with respect to the base 46 such that the claws 54 are directed partially inwardly toward the center of the base 46.

Each of the first set of claws 52 is also bent longitudinally along a midline 58 of the claw 52. This bend serves to stiffen and reinforce the claw 52 against undesirable bending along the claw 52 during installation.

The base 46 of the fastener 44 further includes a plurality of projections 60 protruding from the first side 48 thereof. The projections 60 are somewhat hemispherical and are located on the base 46 between each of the first claws 52.

The wider dimension of the base 46 of the fastener 44 compared with the base 30 of the fastener 28, along with the use of a greater number of claws 52,54, results in a more secure attachment of the sheet retaining device 10 to the cover member 12, which is suitable for larger ring binders.

The description set forth previously with respect to the first embodiment is equally applicable to the remainder of the second embodiment For example, assembly of the sheet retaining device 10 to the cover member 12 utilizing the fastener 44 of the second embodiment is essentially the same as the assembly method using the fastener 28 of the first embodiment.

It should be understood that while the preferred embodiment describes the sheet retaining device 10 as being attached to the spine 14 of the cover member 12, the sheet retaining device 10 may instead be attached to the front cover or the back cover of the cover member 12.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A fastener for securing a sheet retaining device having an aperture at each end thereof to a cover member, said fastener comprising:

a base having a first side and an opposed second side;

an elongated member having a first end secured to said first side of said base, and a second end insertable through said aperture and securable to the sheet retaining device; and a plurality of deformable claws extending from said base in a direction away from said second side for engagement with the cover member.

2. The fastener as set forth in claim 1, wherein said base and said claws are a one-piece unitary structure.

3. The fastener as set forth in claim 1, wherein said elongated member is spot welded to said bases.

4. The fastener as set forth in claim 1, wherein said claws are located approximately centrally of said base and arranged in a circle.

5. The fastener as set forth in claim 1, wherein said base is substantially rectangular.

6. The fastener as set forth in claim 5, wherein said claws comprise a first set of claws located approximately centrally of said base and arranged in a circle, and a second set of claws arranged at opposite side edges of said base.

7. The fastener as set forth in claim 6, wherein said first set of claws are directed partially outwardly, and said second set of claws are directed partially inwardly.

8. The fastener as set forth in claim 1, wherein said claws extend from a peripheral edge of said base.

9. The fastener as set forth in claim 8, wherein said claws are directed inwardly from said peripheral edge of said base.

10. The fastener as set forth in claim 1, wherein said elongated member is substantially cylindrical.

11. The fastener as set forth in claim 10, wherein said claws are bent about a midline extending along each claw for reinforcing the claws.

12. The fastener as set forth in claim 1, wherein said first side of said base includes a plurality of projections protruding therefrom.

13. The fastener as set forth in claim 12, wherein said projections are located between said claws.

14. A binder assembly comprising:

a cover member having a front cover, a back cover, and a spine located between said front cover and said back cover;

a sheet retaining device having an aperture at each end thereof; and a fastener securing the sheet retaining device to the cover member, said fastener comprising a base having a first side and an opposed second side, an elongated member having a first end secured to said first side of said base, and a second end inserted through said aperture and secured to the sheet retaining device, and a plurality of deformable claws extending from said base in a direction away from said second side and embedded into the cover member.

15. The binder assembly as set forth in claim 14, wherein said sheet retaining device has a plurality of rings for engaging corresponding holes in sheets of material retained by said sheet retaining device.

16. The binder assembly as set forth in claim 14, wherein said claws are concealed from an outer surface of said cover member.

17. The binder assembly as set forth in claim 14, wherein said sheet retaining device is secured to said spine.

18. The binder assembly as set forth in claim 14, wherein said elongated member of said fastener is secured to said sheet retaining device by pressing.

19. The binder assembly as set forth in claim 14, wherein said first side of said base includes a plurality of projections protruding therefrom which are in contact with said elongated member.

20. The binder assembly as set forth in claim 14, wherein said elongated member of said fastener is secured to said base by spot welding.

21. The binder assembly as set forth in claim 14, wherein said base and said claws are a one-piece unitary structures.

22. The binder assembly as set forth in claim 14, wherein said base is substantially rectangular.

23. The binder assembly as set forth in claim 14, wherein said claws extend from a peripheral edge of said base.

24. The binder assembly as set forth in claim 23, wherein said claws are directed inwardly from said peripheral edge of said base.

25. The binder assembly as set forth in claim 14, wherein said claws comprise a first set of claws located at an approximately central portion of said base and arranged in a circle, and a second set of claws arranged at peripheral edges of said base.

26. The binder assembly as set forth in claim 25, wherein said first set of claws are directed partially outwardly, and said second set of claws are directed partially inwardly.

27. The binder assembly as set forth in claim 15, wherein said sheet retaining device includes a lever at each end thereof for opening and closing said ring members.

28. A method of producing a binder comprising the following steps:

providing a cover member having a front cover, a back cover, and a spine located between said front cover and said back cover;

providing a sheet retaining device having an aperture at each end thereof;

providing a fastener comprising a base having a first side and an opposed second side, an elongated member having a first end and a second end, and a plurality of deformable claws extending from said base in a direction away from said second side;

securing said first end of said elongated member to said first side of said base;

inserting said second end of said elongated member through said aperture in said sheet retaining device;

securing said second end of said elongated member to said sheet retaining device; and pressing the second side of the base toward the cover member to embed the claws into the cover member, thereby securing the sheet retaining device to the cover member.

29. The method of producing a binder as set forth in claim 28, further comprising the step of providing said sheet retaining device with a plurality of rings for engaging corresponding holes in sheets of material retained by said sheet retaining device.

30. The method of producing a binder as set forth in claim 29, further comprising the step of providing said sheet retaining device with a lever for opening and closing said plurality of rings.

31. The method of producing a binder as set forth in claim 28, wherein said step of securing said first end of said elongated member to said first side of said base includes spot welding.

32. The method of producing a binder as set forth in claim 28, wherein said claws are concealed from an outer surface of said cover member.

33. The method of producing a binder as set forth in claim 28, wherein said sheet retaining device is secured to said spine of said cover member.

34. The method of producing a binder as set forth in claim 28, wherein said step of securing said second end of said elongated member to said sheet retaining device includes pressing.

* * * * *